United States Patent [19]

McKenna

[11] Patent Number: 4,566,303

[45] Date of Patent: Jan. 28, 1986

[54] EXTRUSION MACHINERY

[75] Inventor: Owen P. McKenna, London, England

[73] Assignee: BICC Public Limited Company, London, England

[21] Appl. No.: 620,372

[22] Filed: Jun. 13, 1984

[30] Foreign Application Priority Data

Jun. 23, 1983 [GB] United Kingdom ..... 8317072

[51] Int. Cl.[4] ..... B21C 23/00; B21D 37/16

[52] U.S. Cl. ..... 72/262; 72/342; 29/434; 425/376 B; 425/378 R

[58] Field of Search ..... 72/253.1, 262, 342; 419/41, 67; 425/79, 376 B, 378 R, 383; 165/81, 82; 29/434; 285/187

[56] References Cited

U.S. PATENT DOCUMENTS

| | | | |
|---|---|---|---|
| 338,783 | 3/1886 | Ritchie | 285/187 |
| 2,363,526 | 11/1944 | Hobbs | 165/82 |
| 3,656,784 | 4/1972 | Dow et al. | 285/187 |
| 4,468,945 | 9/1984 | Fairey | 72/262 |

FOREIGN PATENT DOCUMENTS

| | | | |
|---|---|---|---|
| 1370894 | 10/1974 | United Kingdom | 72/262 |
| 2069389A | 8/1981 | United Kingdom | 72/262 |
| 2089703 | 6/1982 | United Kingdom | 72/262 |
| 2102321A | 2/1983 | United Kingdom | 72/262 |
| 2124529 | 2/1984 | United Kingdom | 72/262 |

*Primary Examiner*—Lowell A. Larson

*Attorney, Agent, or Firm*—Parkhurst & Oliff

[57] ABSTRACT

Conform machinery for continuous friction-effected extrusion having a wheel comprising two cheek members, a central hub which forms the base of the working passageway and two separate ring members which form the side walls of the working passageway and provide slip surfaces between the cheek members and the rings. The abutting slip surfaces of the cheek members and rings are shaped to allow thermal expansion of the rings relative to the cheek members with the slip surfaces in driving engagement but to limit radial movement in a radial direction at any particular place on the circumference to a distance less than the relative expansion in the diameter of the ring between ambient temperatures and the expected working conditions of the machine.

5 Claims, 1 Drawing Figure

EXTRUSION MACHINERY

Figure 1:
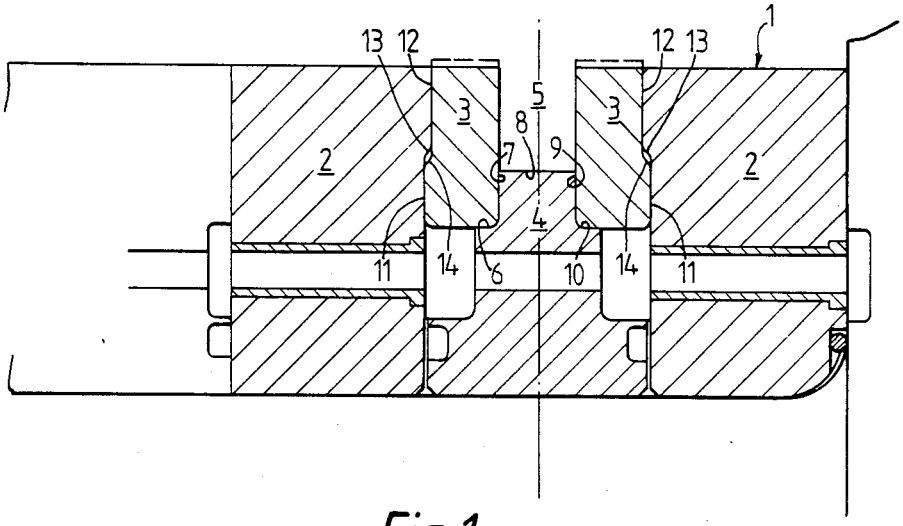

This invention relates to machinery for continuous friction-effected extrusion, primarily but not exclusively of metal. More particularly it relates to machinery of the kind in which a passageway is formed between an arcuate first member and a second member in the form of a wheel having a circumferential groove formed in its peripheral surface into which groove the first member projects, the wheel being rotatable to urge material in the passageway towards one end (the exit end) thereof, an abutment member extending across the passageway at the exit end thereof and at last one die orifice through the abutment member or through an adjacent part of the arcuate first member.

The abutment member may be large enough to block the end of the passageway completely (as described in the specification of UK Pat. No. 1370894) but especially when the material to extruded is a relatively hard metal, such as copper, we prefer that the abutment member is of substantially smaller cross-section than the passageway and leaves a substantial gap between the abutment member and the groove surface and that the material being extruded is allowed to adhere to the groove surface, whereby a substantial proportion of the metal (as distinct from the inevitable leakage of flash through a working clearance) extends through the clearance and remains as a lining in the groove to re-enter the passageway while the remainder of the metal extrudes through the die orifice(s), as described in our UK Pat. No. 2069389B.

Such machinery is commonly known as "Conform" machinery, and will be referred to as such hereinafter.

The wheel of Conform machinery is subject to very high, and cyclic, stresses and is liable to premature failure through fatigue cracking at the base of the groove or elsewhere, which adversely affects the operation of the machinery through high down-time and considerable replacement cost, and the sidewalls of the groove wear rapidly.

The fatigue cracking problem has led to the adoption, in place of a monolithic wheel construction, of a wheel comprising two cheek members forming sidewalls of the passageway and a central hub forming the base of the passageway, the theory being that limited relative movement between the three parts could reduce stresses in the critical corner area and so postpone failure; but results obtained by this device have been disappointing.

Further attempts to improve the lifetime of the wheel have led to the lining of the walls of the working passageway with rings of a hardwearing material as described, for example, in our UK patent application Ser. No. 2102321A but, again, the results obtained by this device have been disappointing; after only a short period of use, the thermal expansion of the rings caused the rings to become eccentric and to wear unevenly.

In accordance with the invention, Conform machinery for continuous friction-effected extrusion having a wheel comprising two cheek members, a central hub which forms the base of the working passageway and two separate ring members which form the sidewalls of the working passageway and provide slip surfaces between the cheek members and the rings; the abutting slip surfaces of the cheek members and rings being shaped to allow thermal expansion of the rings relative to the cheek members with the slip surfaces in driving engagement but to limit movement in a radial direction at any particular place on the circumference to a distance less than the relative expansion in the diameter of the ring between ambient temperature and the expected working conditions of the machine.

Preferably the local radial movement is limited to a value substantially equal to one half of the said relative expansion in diameter so as to prevent eccentric movement substantially entirely without generating large thermally induced stresses.

Preferably relative movement is limited by at least one annular surface on each cheek member facing inwardly (towards the wheel axis) and engaging an outward facing annular surface on the contiguous ring after a predetermined degree of relative radial movement has taken place. Preferably there is only one such annular surface on each member with the remainder of the slip surfaces planar and normal to the axis of the wheel. Preferably the annular surfaces are frustoconical, but they could be cylindrical or of other suitable shape.

Preferably the slip surfaces are free of sharp edgs and sharp internal corners.

Preferably the ring members and/or the central hub are shot peened prior to assembly of the machinery. We have found that shot peening these surfaces improves the coating of the working passageway and also reduces the rate at which the ring members become deformed by superficial plastic flow adjacent to the first member.

The invention will now be further described, by example, and with reference to the accompanying drawing which is a radial cross-section through the periphery of a wheel for use in Conform machinery in accordance with the invention.

The wheel 1 comprises two cheek members 2, two rings 3 and a central hub 4. The central hub and two rings form the base and sidewalls respectively of the working passageway 5.

All the surfaces of the rings and surfaces 6, 7, 8, 9 and 10 of the central hub were shot peened prior to assembly of the machinery.

The slip surfaces between the cheek members 2 and the rings 3 are made up of inner and outer flat parts 11, 12 which are always in contact when the wheel is assembled. Between the inner and outer parts of the slip surface of each cheek member is an inwardly-facing annular surface 13 which is frustoconical, a suitale semi-angle being 45°. Correspondingly the rings have outwardly-facing annular surfaces 14, but when the wheel is at ambient temperature a small clearance exists between the surfaces 13 and 14.

In use, the rings 3 are subject to the high temperatures set up in the working passageway 6 which leads to greater expansion of the rings than the cheek members (assuming comparable thermal expansion coefficients). The initial expansion of the rings 3 is allowed once friction on the flat surfaces 11 and 12 is overcome, but as soon as any part of the surfaces 13 and 14 come into engagement further relative movement there is inhibited so that eccentricity is limited and if the dimensions are optimised can be substantially avoided.

In a particular example, the wheel circumference is 1 m; the rings 3 are made of the alloy sold under the trade mark Inconel as "Inconel Alloy 718" identified in U.K. Application Ser. No. 2102321A and have a radial width of 25 mm and an axial thickness of 14 mm at its thicker part; the cheek members 2 and the hub 4 are made of BH13 steel. The rings and the central hub were shot peened by bombarding the surfaces with steel spheres, 0.76 mm in diameter projected by an airstream from a pressure of 690 $KNM^{-2}$ at a nozzle 9.5 mm in diameter, until a C2 Almen strip treated to the same extent had an Almen arc height of 0.2 mm. The radial gap between surfaces 13 and 14 at 20° C. is 0.6 mm, which falls to zero when extruding copper at such a rate that the mean temperature of the rings rises to 280° C.

What I claim as my invention is:

1. Conform machinery for continuous friction-effected extrusion having a wheel comprising:

two cheek members;

a central hub;

two separate ring members each located between said central hub and a respective said cheek, said rings having external diameters larger than said central hub so that a working passageway is formed with said central hub and each said ring defining a wall thereof;

abutting slip surfaces on said cheek members and said rings, said abutting slip surface on each cheek member being in driving engagement with said abutting slip surface on the corresponding ring, said abutting slip surface on each cheek member having at least one annular surface facing inwardly toward an axis of the wheel and said abutting slip surface of each ring having at least one annular surface facing outwardly away from the axis of the wheel and disposed radially inwardly from the at least one annular surface of the corresponding cheek member, thereby to allow relative thermal radial expansion of said rings with respect to said cheek members until said annular surfaces engage one another, said radial expansion at any particular place on the circumference of said rings being limited to a distance less than the relative expansion in the diameter of the rings between ambient temperature and the expected working conditions of the machine.

2. Conform machinery as claimed in claim 1, wherein said radial expansion at any particular place is limited to a value substantially equal to one half of said relative expansion in diameter so as to prevent eccentric movement substantially entirely without generating large thermally induced stresses.

3. Conform machinery as claimed in claim 1, wherein there is only one annular surface on each cheek member and each ring, with the remainder of the slip surfaces planar and normal to the axis of the wheel.

4. Conform machinery as claimed in claim 3, wherein the annular surfaces are frustoconical.

5. Conform machinery as claimed in claim 1, wherein the slip surfaces are free of sharp edges and sharp internal corners.

* * * * *